United States Patent [19]

Pusic

[11] Patent Number: 5,074,259

[45] Date of Patent: Dec. 24, 1991

[54] ELECTRICALLY OPERATED CYLINDER VALVE

[76] Inventor: Pavo Pusic, 164 McKinley Ave., East Hanover, N.J. 07936

[21] Appl. No.: 520,725

[22] Filed: May 9, 1990

[51] Int. Cl.[5] ..... F01L 9/04

[52] U.S. Cl. ..... 123/90.11; 251/129.1; 251/129.16

[58] Field of Search ..... 123/90.11; 251/129.05, 251/129.1, 129.16

[56] References Cited

U.S. PATENT DOCUMENTS

| | | | |
|---|---|---|---|
| 4,682,574 | 7/1987 | Kreuter | 123/90.11 |
| 4,719,882 | 1/1988 | Kreuter | 123/90.11 |
| 4,779,582 | 10/1988 | Lequesne | 123/90.11 |
| 4,777,915 | 10/1988 | Bonvallet | 123/90.11 |
| 4,823,825 | 4/1989 | Buchl | 123/90.11 |
| 4,829,947 | 5/1989 | Lequesne | 123/90.11 |
| 4,841,923 | 6/1989 | Buchl | 123/90.11 |
| 4,846,120 | 7/1989 | Buchl | 123/90.11 |

FOREIGN PATENT DOCUMENTS

| | | | |
|---|---|---|---|
| 3500530 | 7/1986 | Fed. Rep. of Germany | 123/90.11 |
| 0162312 | 9/1984 | Japan | 123/90.11 |

*Primary Examiner*—David A. Okonsky
*Assistant Examiner*—Weilun Lo
*Attorney, Agent, or Firm*—Marks Murase & White

[57] ABSTRACT

An electrically operated cylinder valve and a valve operating device for an internal combustion engine is disclosed. The valve is operated by electromagnetic means energized by electrical currents which are controlled by electronic means. The flow of currents determines the valve timing, duration, and lift according to requirements for optimal engine performance under different operating conditions.

19 Claims, 2 Drawing Sheets

ELECTRICALLY OPERATED CYLINDER VALVE

BACKGROUND OF THE INVENTION

Intake and exhaust cylinder valves have been used in internal combustion engines from their very beginning. Various types of valves have been used in the past including poppet, reed, sliding-sleeve, and rotary types. Typically, a modern four-stroke internal combustion engine uses poppet valves and a two-stroke internal combustion engine uses reed valves. Poppet valves are operated by different types of valve trains and reed valves are operated by air pressure.

The most typical modern four-stroke engine has two intake and two exhaust valves located inside each cylinder head and operated by two parallel camshafts (DOHC). The camshafts are driven from the crankshaft by sprockets and chain or toothed belt. The camshaft sprocket is twice as large as the crankshaft sprocket which causes the camshaft to turn at half the speed of the crankshaft. Thus, every two revolutions of the crankshaft produce one revolution of the camshaft. The camshaft has one or more camshaft lobes which press against cam followers. The cam followers can be either hydraulic or mechanical.

Because of the significant advantages regarding valve operation and maintenance, most modern engines use hydraulic cam followers (lifters) which provide smooth and quiet self-adjusting operation. The shape of the cam lobes determines the valve's timing, duration, and lift. The valve's timing, duration, and lift are critical for engine performance because they determine engine breathing. Therefore, different shapes of cam lobes are required for engines with different operating speeds. Since the shape of cam lobes can not be changed during engine operation, it does not allow adjustment to achieve optimal engine performance during engine operation. A recent development provides two different camshafts which operate the same valves according to different requirements, i.e., the first camshaft operates the valves at low operating speeds and the second camshaft operates the same valves at high operating speeds. This provides better engine operation and decrease exhaust pollution.

In any case valve operation requires a complicated and expensive mechanical configuration which has a negative effect on engine volume and increases manufacturing costs.

Therefore, it is an object of the present invention to provide a device which will enable optimal engine performance, significantly simplify valve train configuration and, consequently, significantly decrease manufacturing costs and engine volume.

SUMMARY OF THE INVENTION

The present invention provides a device which will enable intake and exhaust valves to be opened and closed by electromagnetic means. It will eliminate the entire portion of valve trains presently required to translate a rotary motion of the crankshaft into linear, or straight-line motion of the valves. It will also enable valve timing, duration, and lift to be determined by electronic control means according to the requirements that result in optimal engine operation. Namely, unlike the present valve trains which do not provide the possibility to change valve timing, duration, and lift, the electronically controlled device will enable different valve operation under different engine operating speeds. It will enable the valve's timing, duration, and lift to be adjusted during engine operation in response to sensors which sense conditions indicative of engine performance.

The present invention provides electromagnetic means which will cause valve opening and closing according to electronically controlled electrical current. By energizing electromagnetic means located closer to the valve port, the valve will be forced into an open position and by energizing electromagnetic means located above the valve stem tip, the valve will be forced into a closed position. Also, by reversing the electrical current the valve will be repelled from the electromagnetic means as explained later in this description.

The operation of the intake valve will not require significant power since there is no opposite pressure exerted on the valve head during its operation. Except for the very short period during the valve overlap, the vacuum inside the cylinder and flow of air-fuel mixture act in the same direction as the intake valve movement during the intake stroke. During the compression stroke, the pressure inside the cylinder also acts in the same direction as the intake valve movement.

The operation of the exhaust valve will require electromagnetic means to push the valve against the pressure developed by combustion at the point when the engine piston approaches its BDC. Since this will occur near the end of the power stroke, the electromagnetic means will be able to overcome the opposite-acting force developed by the exhaust gas pressure. During the closing of the exhaust valve (end of exhaust stroke and beginning of intake stroke) there will be no opposite-acting force exerted on the valve head.

According to the above stated facts, it is obvious that the electromagnetic means will be able to perform valve opening and closing without using any extensive power. Also, since the electromagnetic means can act with much higher speed than the mechanical means, the valves will be able to open and close much faster than in the prior art and, consequently, enable better engine breathing. Also, because the valve timing is electronically controlled it can be continuously adjusted in response to sensed operating conditions during engine operation to optimize engine performance.

The present invention also provides yet another embodiment wherein a spring is provided to open the valve and a solenoid is provided to pull the valve back into a closed position.

All features and advantages of the present invention will become apparent from the following brief description of drawings and description of the preferred embodiment.

DETAILED DESCRIPTION OF THE PREFERRED EMBODIMENT

Figure 1:
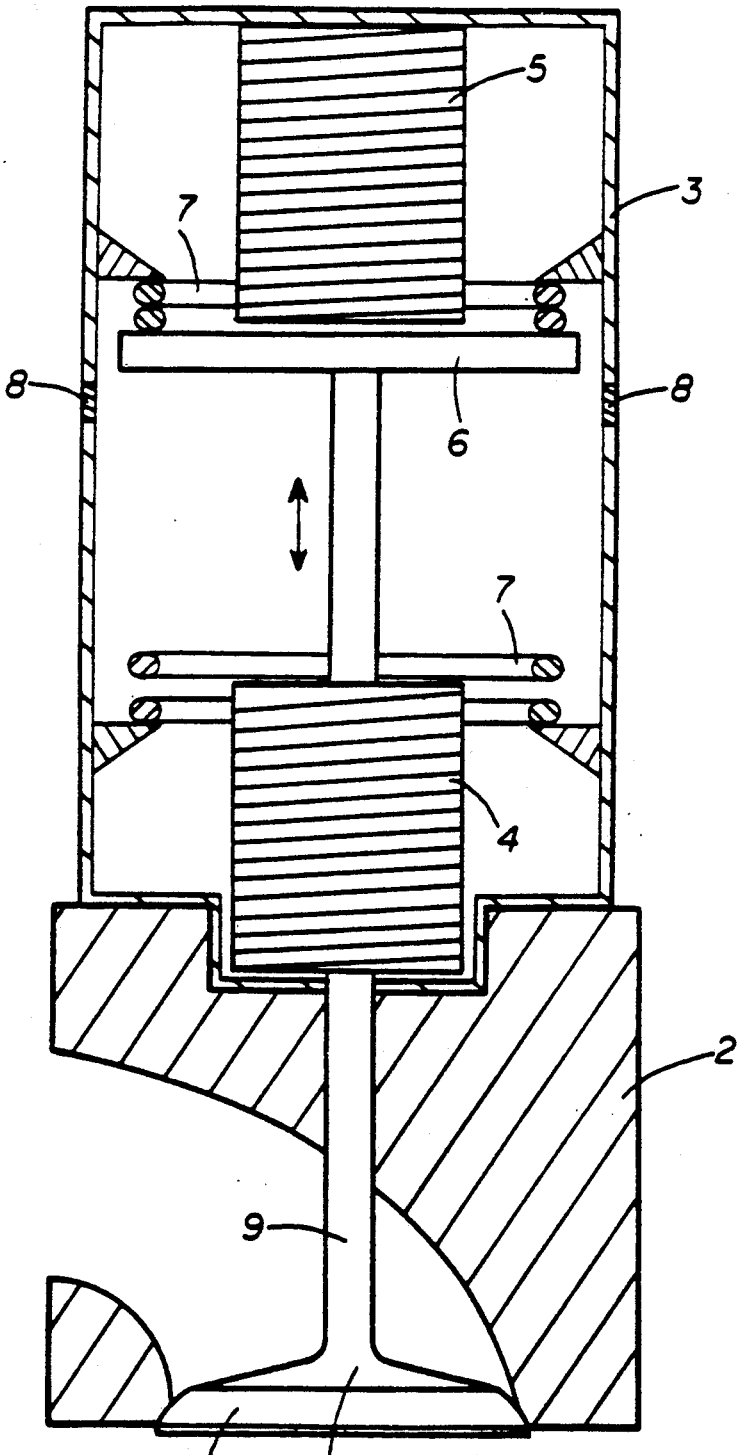
FIG. 1 is the side view of a valve and an electromagnetic device according to the first embodiment of the present invention.

Referring to FIG. 1, there is shown the first embodiment of the present invention comprising a poppet cylinder valve which corresponds to the valve known from the prior art. The magnetic disc 6 is mounted and locked on the valve stem tip. The valve stem 9 is inserted into the integral, or pressed-in, valve guide in the cylinder head 2. The electromagnetic device, also shown on FIG. 1, is mounted on the valve head 2. It comprises two electromagnets 4 and 5 located on the opposite sides, and a cylindrical wall 3. The first (lower) electromagnet 4 is located below the disc 6 and the second (upper) electromagnet 5 is located above the disc 6. The disc 6 is larger than the electromagnets 4 and 5 in order to be able to press the springs 7 which are located around the electromagnets 4 and 5 and connected on the extended portions of the cylindrical wall 3.

It is assumed that the electrical currents are controlled by an electronic control unit (ECU), not shown on FIGS., which provides and stops the electrical currents to the electromagnets 4 and 5 according to requirements for optimal engine performance. The ECU receives signals from sensors which sense engine operating conditions and determines valve timing, duration, and lift by timing the electrical currents. The maximum valve lift is determined by the distance between the electromagnets 4 and 5 and the springs 7.

According to the process of the invention, when an electrical current is provided through the first electromagnet 4 it produces a positive magnetic field which attracts the magnetic disc 6 and pulls it downwards. This causes the valve 1 to open and to remain in its ultimate lower position as long as the positive magnetic field exists. When approaching the electromagnet 4, outer sections of the disc 6 press against the spring 7 which is provided around the electromagnet 4 in order to absorb valve's inertia load. This will also enable smoother and more quiet operation, and prevent collision of the disc 6 and the electromagnet 4. Also, when the electromagnetic polarity changes, the spring 7 will push the valve in the opposite direction.

When the valve 1 is to be closed, the ECU reverses the flow of the current in the first electromagnet 4 which repels the magnetic disc 6 and, simultaneously, provides the electrical current through the second electromagnet 5. The electrical current through the second electromagnet 5 creates positive magnetic field which attracts the magnetic disc 6 and pulls it upwards. This causes the valve to close and to remain in its ultimate upper position as long as this positive magnetic field exists. When the ECU reverses the flow of current through the second electromagnet 5, the magnetic disc 6 is repelled downwards and the process continues as described for upward movement. Also, the spring 7 around the second electromagnet 5 pushes the disc 6 downwards.

It is to be understood that the term "positive magnetic field" in this text refers to such magnetic field which attracts the magnetic disc 6 either towards the first 4 or the second 5 electromagnet. This term is used only to distinguish the magnetic fields which attract the magnetic disc 6 from the magnetic fields which repel the disc 6 in this description.

It is assumed that the valve stem 9 is manufactured of such material(s) which will not produce any magnetic effect when sliding through the first electromagnet 4 either during the existence or absence of the magnetic fields in the electromagnet 4. Since the valve stem 9 has to slide through the middle section of the bottom part of the electromagnetic device, it may be desirable to provide three smaller electromagnets instead of one (the first electromagnet 4) as described for the preferred embodiment. In this case, the valve stem will not slide through the electromagnet 4 but between the electromagnets. Also, the spring 7 will be provided in this case.

In order to protect the valve from collision with engine piston when there is no electrical current present in any of the electromagnets 4 and 5, the wall 3 between the electromagnets can be made of two different materials. The lower section of the wall 3 is made of the material which does not attract the disc 6 and the part of upper section 8 of the wall 3 is made of the material which attracts the disc 6. Therefore, when engine stops or there is no electrical currents, the valve will be pulled upwards and will remain in a substantially closed position which provides a little clearance between its head 10 and the piston head in its TDC.

Since the electromagnetic device covers the area above the valve guide, the oil from above will not be able to enter the valve guide and escape into combustion chamber. Therefore, in order to enable smoother valve sliding, a small ball-bearing with permanent lubrication can be inserted below the first electromagnet 4. Also, the means for valve rotation can be provided below the first electromagnet 4.

It is assumed that both electromagnets 4 and 5 are properly insulated in order to prevent any excessive heat transfer from the valve head or the valve stem. If required, the entire device can be cooled by engine cooling means.

Figure 2:
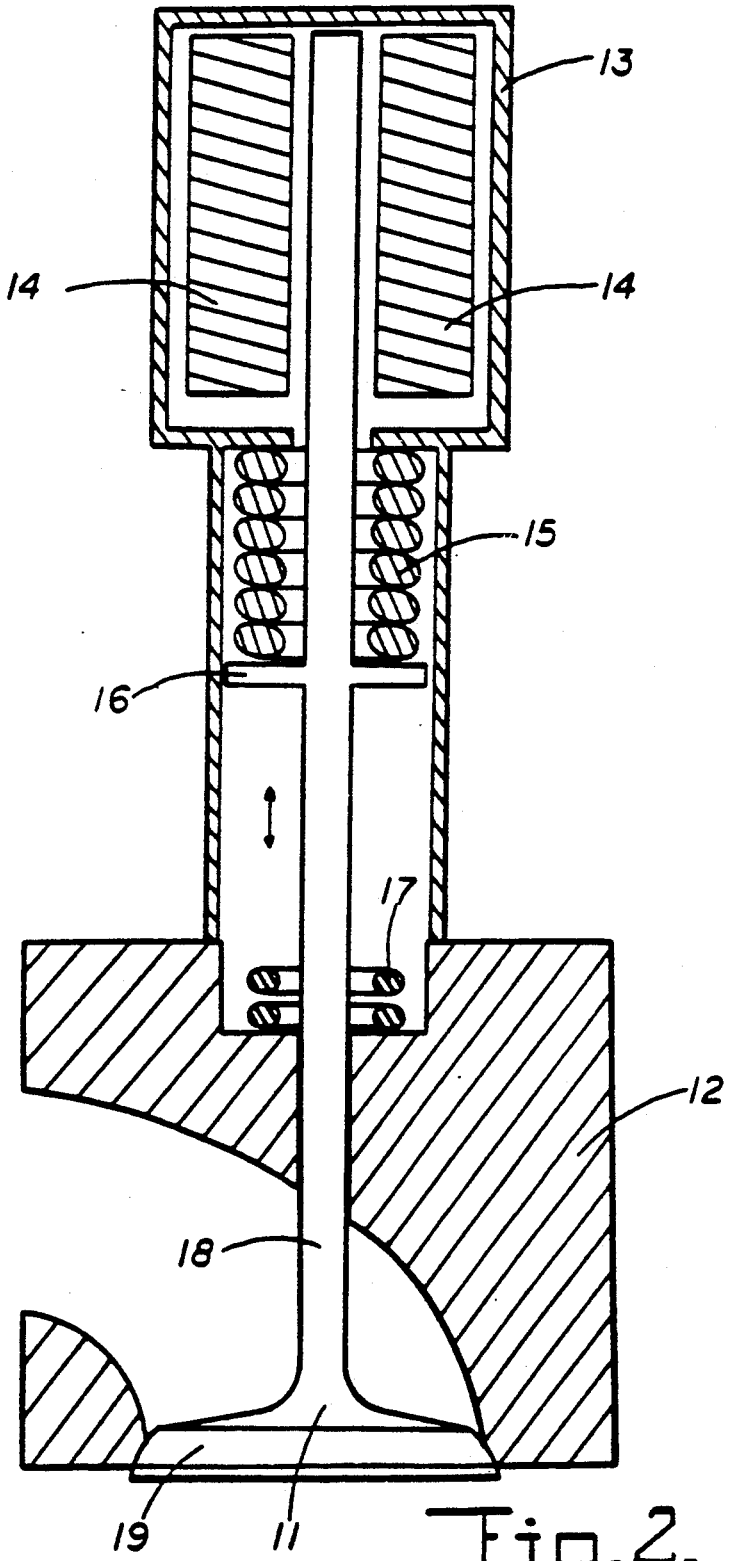
FIG. 2 is the side view of a valve and a solenoid device according to the second embodiment of the present invention.

As shown on FIG. 2, the second embodiment of the present invention provides a device to operate the cylinder valve 11 both by electromagnetic means 14 and the return spring 15. In this case, the valve 11 is displaced into its open position by force of the spring 15 which acts against the disc 16 mounted on the valve stem 18. The spring 17 is provided in the bottom part of the housing 13 in order to absorb the valve's inertia load and enable smooth operation. When the valve is to be closed, the electrical current is provided through the solenoid 14. This creates the magnetic field which attracts the valve stem 18 and, consequently, pulls the valve 11 into closed position. The magnetic field acts against the force of the spring 15 and presses it as long as the magnetic field exists. It is assumed that the electrical current is controlled by ECU which receives signals from sensors which sense engine operating conditions.

It is to be understood that the position of the solenoid and the spring can be reversed, if proven more effective for the purpose of the invention.

As obvious from the above description, the physical configuration of the entire valve operating system is much more simple than the one known in the prior art. It is also obvious that the valve lift can be much longer without any negative effects. It is assumed that the total amount of energy used to operate the valves in an engine will not exceed the amount of energy presently used for this purpose.

Therefore, the obvious advantages regarding engine volume, valve lift, timing, and duration will make the present invention significantly more cost-effective, energy-efficient, and environmentally protective.

It will be understood that the present invention has been described in relation to particular embodiments, herein chosen for the purpose of illustration, and that the claims are intended to cover all changes and modifications, apparent to those skilled in the art, which do not constitute departure from the scope and spirit of the invention.

What is claimed is:

1. An electrically operated cylinder valve and valve operating device for use in an internal combustion engine comprising:

a slidable cylinder valve for selectively opening and closing a valve port, the cylinder valve comprising a valve head, a valve stem, and a disc spaced from the valve head and secured to the valve stem for movement therewith, the disc having first and second sides;

an electromagnetic device for operating the valve, the electromagnetic device having first and second ends and comprising:

a first electromagnet at the first end of the electromagnetic device;

a first inertia absorbing spring located proximate the first electromagnet and adapted to contact the first side of the disc;

a second electromagnet at the second end of the electromagnetic device;

a second inertia absorbing spring located proximate the second electromagnet and adapted to contact the second side of the disc;

the first electromagnet and the second electromagnet and the first inertia absorbing spring and the second inertia absorbing spring being spaced from one another so as to define a substantially fixed valve lift;

wherein the disc is located between the first and second electromagnet and between the first and second inertia absorbing springs, such that the disc is movable between a first position in which the first side of the disc contacts the first inertia absorbing spring while the second side of the disc is spaced from the second inertia absorbing spring and a second position in which the second side of the disc contacts the second inertia absorbing spring while the first side of the disc is spaced from the first inertia absorbing spring;

wherein the disc is moved toward the first position by a simultaneous repelling force of the second electromagnet and attraction force of the first electromagnet and the disc is moved toward the second position by a simultaneous repelling force of the first electromagnet and attraction force of the second electromagnet.

2. The electrically operated cylinder valve and valve operating device of claim 1, wherein the first and second electromagnets are energized by electrical currents from an external source so as to alternately energize the first electromagnet and the second electromagnet to cause the disc to move between the first and second positions thereby causing the valve head to move between a valve port open position and a valve port closed position.

3. The electrically operated cylinder valve and valve operated device of claim 2, wherein the electrical currents are controlled by electronic control means in response to signals indicative of engine operating conditions.

4. The electrically operated cylinder valve and valve operating device of claim 1, further comprising a permanent magnet located between the first and second electromagnets for attracting the disc to a predetermined position in the absence of electrical current.

5. The electrically operated cylinder valve and valve operating device of claim 4, wherein the disc is manufactured of a material which is attracted by the permanent magnet.

6. The electrically operated cylinder valve and valve operating device of claim 1, wherein the electromagnetic device further comprises a housing which houses the disk, the first and second electromagnets and first and second inertia absorbing springs, the housing having cylindrical side walls and first and second end walls, a valve stem receiving opening provided in one of the end walls and insulating means for preventing unwanted transfer of heat and electrically between the housing and the electromagnets.

7. The electrically operated cylinder valve and valve operating device of claim 1, wherein the first and second inertia absorbing springs are relative small coil springs primarily intended to stop the disk with a cushioning effect, the coil springs having less than four coils.

8. An electronic cylinder valve construction comprising:

a cylinder wall formed with a valve port and a valve stem receiving opening;

a valve member comprising a valve head, a valve stem and a disc, the valve head being movable between a valve port open position and a valve port closed position, the valve stem being slidable within the cylinder wall to accommodate movement of the valve head and the disc being spaced from the valve head and secured to the valve stem for movement therewith;

a first electromagnet located between the disk and the valve head;

a first spring located between the disk and the valve head, the first spring having an end adapted to contact the disk; and a second electromagnet separated from the first electromagnet by a predetermined space, the disk being located in the space separating the first and second electromagnets;

a second spring located proximate the second electromagnet, the second spring having an end adapted to contact the disk;

wherein the electromagnets are adapted to move the disk between a first position in which the disk contacts the first spring and is spaced from the second spring and a second position in which the disk contacts the second spring and is spaced from the first spring, the movement of the disk between the first and second positions causing movement of the valve head between the valve port open and valve port closed positions; and wherein the disc is simultaneously repelled by one electromagnet and attracted by the other electromagnet so as to move the valve head either in the valve port open or valve port closed position.

9. The electronic cylinder valve construction of claim 8, further comprising a housing which houses the disk, the first electromagnet, the first spring, the second electromagnet and the second spring, the housing having at least one side wall and two end walls and a valve stem receiving opening formed in one of the end walls for receiving the valve stem.

10. The electronic cylinder valve construction of claim 8, further comprising a permanent magnet located between the first and second electromagnets for attracting the disk to a predetermined position in the absence of electrical current.

11. The electronic cylinder valve construction of claim 8, further comprising an electronic control unit for selectively supplying electrical current to the first and second electromagnets so as to alternately energize the first electromagnet and the second electromagnet thereby causing the disk to move between the first and the second positions and causing the valve head to move between a valve port open position and a valve port closed position.

12. The electronic cylinder valve construction of claim 8, wherein the first and second springs are relatively small inertia absorbing springs primarily intended to stop the disk with a cushioning effect.

13. The electronic cylinder valve construction of claim 8, wherein the first and second springs are coil springs having less than four coils such that the surface of the spring which is adapted to contact the disk is located near an electromagnet so that the disk does not contact the spring until the disk is proximate an electromagnet.

14. The electronic cylinder valve construction of claim 8, wherein at least a portion of the first spring encircles the first electromagnet and at least a portion of the second spring encircles the second electromagnet and the sides of the disk are larger than the sides of the electromagnet such that the disk can press the first and second springs which encircle the electromagnets.

15. The electronic cylinder valve construction of claim 8, wherein the first and second springs are provided around the first and second electromagnets respectively in order to absorb the disk's inertial load and to enable smoother and more quiet operation and prevent collusion of the disk with the electromagnets.

16. The electronic cylinder valve construction of claim 8, wherein the disk is out of contact with both the first and second springs during most of its movement between the first position and the second position.

17. The electronic cylinder valve construction of claim 8, wherein the disk is never in contact with both the first and second springs simultaneously.

18. In an internal combustion engine having an engine cylinder wall, at least one valve port formed in the cylinder wall and a valve member having a disk secured thereto slidable in the cylinder wall between a valve port open and a valve port closed position, a method for controlling the movement of the valve member between the open position and the closed position comprising the steps of:

supplying current to a first electromagnet so as to energize the first electromagnet to cause the disk to move toward a first load absorbing spring and the first electromagnet and supplying reversed current to a second electromagnet so as to energize the second electromagnet to cause the disc to move toward the first load absorbing spring and the first electromagnet;

mechanically stopping the movement of the disc toward the first electromagnet through contact with the first spring before the disc contacts the first electromagnet;

reversing the supply of current to the first electromagnet and substantially simultaneously reversing the supply of current to the second electromagnet so as to energize both electromagnets to cause the disc to move out of contact with the first spring and toward the second load absorbing spring and the second electromagnet;

mechanically stopping the movement of the disk toward the second electromagnet through contact with the second spring before the disk contacts the second electromagnet.

19. The method of claim 18, further comprising the step of controlling the supply of current to the electromagnets in response to signals indicative of engine operating conditions.

* * * * *